United States Patent [19]

Parsons et al.

[11] 4,174,741

[45] Nov. 20, 1979

[54] METHODS FOR LOADING AND UNLOADING LIQUIDS FROM A RAILROAD TANK CAR

[75] Inventors: James D. Parsons, Munster; Jerome A. Sivak, Hammond, both of Ind.

[73] Assignee: Union Tank Car Company, Lincolnshire, Ill.

[21] Appl. No.: 932,892

[22] Filed: Aug. 10, 1978

[51] Int. Cl.[2] ..... B65B 3/06

[52] U.S. Cl. ..... 141/2; 141/5; 141/326; 220/22; 220/85 B; 222/1; 222/386.5

[58] Field of Search ..... 141/1, 2, 4, 5, 9, 18, 141/100, 104, 231, 285, 325, 326, 327, 392; 220/22, 85 B; 222/1, 386.5

[56] References Cited

U.S. PATENT DOCUMENTS

| | | | |
|---|---|---|---|
| 2,758,747 | 8/1956 | Stevens | 220/22 |
| 2,956,839 | 10/1960 | Hermanns | 302/52 |
| 2,984,392 | 5/1961 | Wadenby | 222/386.5 |
| 3,172,556 | 3/1965 | Stiefel | 220/22 |
| 3,351,235 | 11/1967 | Paton | 222/1 |
| 3,396,762 | 8/1968 | Paton | 141/7 |
| 3,477,611 | 11/1969 | Niles | 220/85 B |
| 3,727,795 | 4/1973 | Willsey | 220/85 B |

*Primary Examiner*—Frederick R. Schmidt

*Attorney, Agent, or Firm*—Charles M. Kaplan; Joel E. Siegel

[57] ABSTRACT

A flexible diaphragm can be moved to line opposite surfaces of a vehicle container so that incompatible fluids alternately can be transported in the vehicle without the need for cleaning it. The container is loaded and unloaded in a manner which causes the diaphragm to neatly lie against the container surface without forming wrinkles, creases or bubbles. The movement of the diaphragm is controlled by the sequence and timing by which inlet and outlet conduits on opposite sides of the diaphragm are opened and closed.

10 Claims, 9 Drawing Figures

METHODS FOR LOADING AND UNLOADING LIQUIDS FROM A RAILROAD TANK CAR

BACKGROUND OF THE INVENTION

This invention relates to the storage of fluids, and more particularly to methods for loading and unloading different liquids from a liquid transporting vehicle.

When a tank truck or a railroad tank car transporting a particular gas or liquid is to be used to transport a different non-compatible fluid, it is necessary to clean the container of the vehicle. This is usually expensive and inconvenient, and the required specialized cleaning facilities frequently are not available. To solve this problem, it has been proposed that vehicles for transporting fluids be provided with a pair of separate inlets and outlets and a flexible diaphragm that alternately lines opposed sides of the vehicle's container. Movement of the diaphragm to line one side of the container provides a chamber for one fluid, and movement of the diaphragm to the opposite side of the container provides another chamber for a different non-compatible fluid. Thus, the container does not have to be cleaned to enable the vehicle to transport either of such fluids. However, there has not been any significant use of such vehicles having a diaphragm that enables them to alternately carry non-compatible fluids without being cleaned in between. One reason such vehicles have not been used is that the full volumetric capacity of such vehicles was not available for the transportation or storage of fluid. When such vehicles were loaded or unloaded, the flexible diaphragm would not properly line the surface of the vehicle container. The diaphragm would become creased or wrinkled and consequently would not be able to define a liquid storage chamber that includes the entire surface of the container. This would significantly reduce the amount of liquid that could be transported (e.g. by 20%). The usable volume of the container was also reduced when gas or liquid was trapped like a bubble between the flexible diaphragm and the container because of incomplete unloading.

OBJECTIVES OF THE INVENTION

Accordingly, it is an object of this invention to provide improved methods for storing and transporting non-compatible liquids.

Another object is to provide improved methods of loading and unloading liquid from a container that is divided into separate chambers by a flexible diaphragm.

Another object is to prevent a flexible diaphragm in a liquid container from being creased or wrinkled when the container is loaded or unloaded.

Another object is to maintain a flexible diaphragm in tension at least part of the time during which liquid is loaded or unloaded from a container.

Another object is to prevent gas or liquid bubbles from forming under a diaphragm used to define chambers for different liquids in a container.

Another object is to quickly and completely unload a liquid from a container for non-compatible liquids.

Another object is to increase the usable volume of a container that employs a flexible diaphragm to store non-compatible liquids.

Another object is to provide improved methods of quickly and safely loading and unloading a railroad tank car that do not possess defects inherent in similar prior art procedures.

Another object is to prevent damage to a flexible diaphragm when liquid is loaded or unloaded from a container.

Other objects and advantages of the invention will be found in the specification and claims, and the scope of the invention will be pointed out in the claims.

Briefly stated, according to one aspect of the invention, a container which has its interior changeable into different chambers for non-compatible liquids by a flexible diaphragm that alternately lines opposite portions of the container may be loaded with liquid by sealing one of the chambers and thereby trapping air on one side of the diaphragm. The opposite side of the diaphragm is vented to the atmosphere and liquid is flowed into the chamber on such opposite side. The trapped air is displaced by rising liquid and moves the upper portion of the diaphragm in one direction while the rising liquid moves the lower portion of the diaphragm in the opposite direction. This puts the diaphragm in tension and removes wrinkles and creases by stretching out the diaphragm. The trapped air must be vented before the container can be filled with liquid. According to another aspect of the invention, the liquid can be unloaded from such a container by draining the liquid from the lower portion of a chamber on one side of the diaphragm when the upper portion of such chamber is sealed to the atmosphere. The chamber on the opposite side of the diaphragm is vented to the atmosphere. This permits formation of a partial vacuum above the liquid which puts the diaphragm in tension and stretches it out as the level of the liquid descends.

DESCRIPTION OF THE INVENTION

Figure 1:
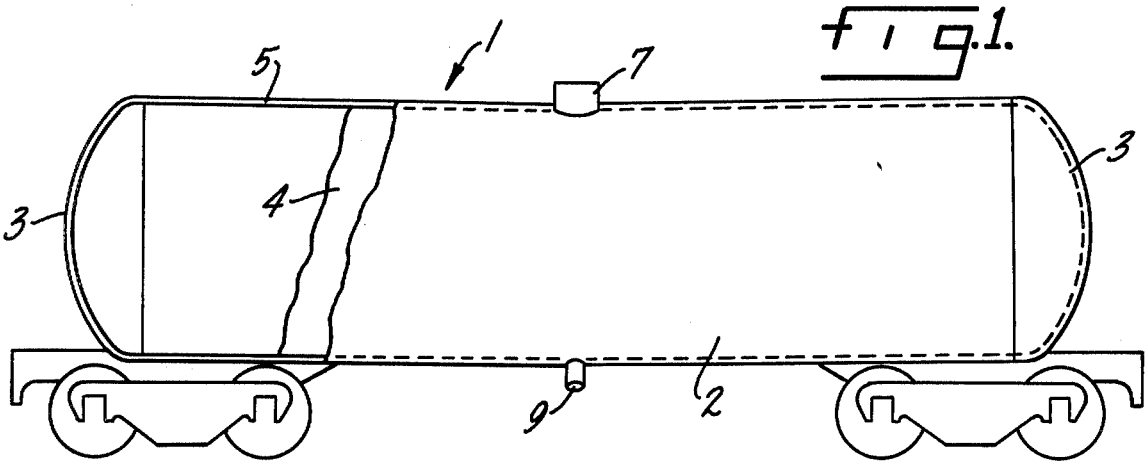
FIG. 1 is a schematic, partially broken-away side view of a railroad tank car capable of practicing the methods disclosed herein.

The drawing shows a railroad tank car 1 including a metal container 2 for storing and transporting alternately two different non-compatible liquids, such as a lube oil and diesel oil. Container 2 is generally cylindrical, and has a generally horizontal longitudinal axis; its ends are closed by dished heads 3. Container 2 encloses a diaphragm 4 made from a flexible material such as a nylon-fabric-reinforced Buna-N rubber; suitable clamp means 5 seals the peripheral edge of diaphragm 4 against the inside surface of container 2 in a vertical plane that bisects the container. A pair of manways including vent pipes provide liquid inlet conduits 6 and 7 located adjacent the top surface of container 2 on opposite sides of diaphragm 4, and a pair of liquid outlet conduits 8 and 9 are located adjacent the bottom surface of container 2 on opposite sides of diaphragm 4. Conventional lids or valves may be used for opening and closing conduits 6–9. Car 1 should be provided with other necessary components and accessories, such as trucks, draft gear and gauges, which do not form part of the present invention.

Figure 6:
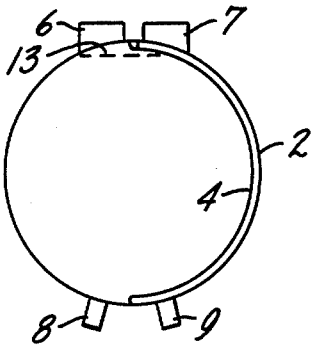

When container 2 is filled with a specific liquid through inlet conduit 6, diaphragm 4 will lie against the inside wall surface on the right side of container 2 (as seen in FIG. 6) and define a chamber for such liquid; such liquid would be drained through outlet conduit 8. When container 2 is filled with a non-compatible liquid through inlet conduit 7, diaphragm 4 will be against the left wall surface of container 2 and define a different chamber for the non-compatible liquid; this liquid would be drained through outlet conduit 9. The separate chambers for non-compatible liquids are hermetically isolated, so it is not necessary to clean container 2 whenever car 1 carries either of such liquids.

Figure 2:
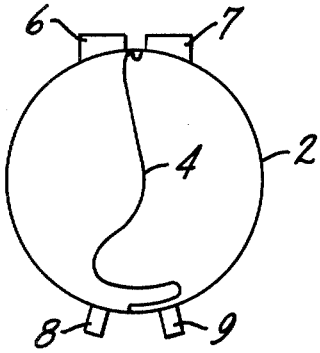
FIGS. 2–6 are cross sectional views taken generally through the center of the tank car in FIG. 1 illustrating in sequence the positions of the diaphragm during the method of loading a tank car in accord with this invention.
Figure 3:
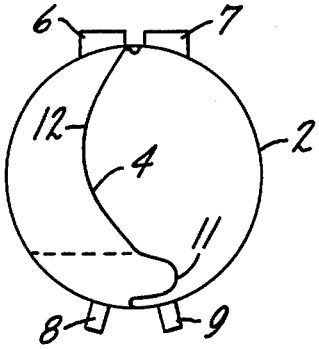
Figure 4:
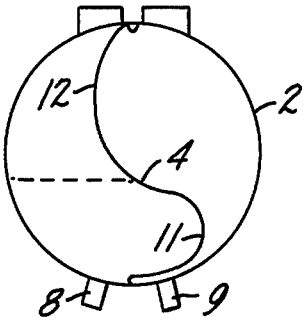
Figure 5:
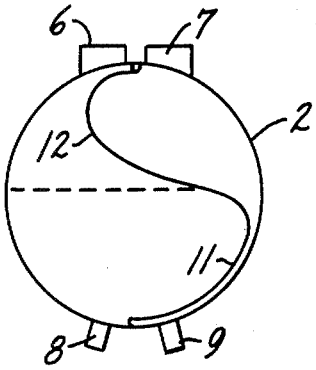

In FIG. 2, container 2 is empty, and diaphragm 4 should hang loosely in the central portion of the container. Container 2 can be loaded with liquid in a way which causes diaphragm 4 to smoothly and uniformly line a side of the container without forming significant creases, wrinkles or bubbles. First, outlet conduits 8 and 9 are both closed. Inlet conduit 7 on one side of diaphragm 4 should be closed, when container 2 is to be loaded through the inlet conduit 6 on the opposie side of the diaphragm. With conduit 6 open, liquid is flowed into container 2 and initially pushes the lower portion 11 of diaphragm 4 against the lower portion of the right side of the container as shown in FIG. 3. The chamber being filled with liquid should be vented to the atmosphere through open conduit 6 or other means associated with its manway to permit escape of air displaced by the incoming liquid, but the air in the right side of container 2 is trapped because conduits 7 and 9 are both closed. Thus as liquid flows into the left side of container 2 the lower portion 11 of diaphragm 4 is moved to the right against the resistance of the trapped air. This resistance puts diaphragm 4 in tension and straightens out and tightens the diaphragm, as it causes the diaphragm to push slowly against the trapped air. This movement against the resistance of trapped air prevents the formation of creases, wrinkles and bubbles. As air is displaced from the bottom of container 2 by the incoming liquid, the trapped air pushes the upper portion 12 of diaphragm 4 to the left. As more liquid flows into container 2, the rising liquid continues to move the lower portion 11 of diaphragm 4 smoothly and evenly up the right side of container 2, and to displace more trapped air which pushes the upper portion 12 of diaphragm 4 farther to the left, as shown in FIG. 4. Eventually the upper portion 12 of diaphragm 4 is pushed so far to the left by the displaced air that it will cover all or part of inlet conduit 6 and thus will interfere with or prevent the flow of the incoming liquid, as shown in FIG. 5. Consequently, after container 2 is partially filled with liquid, inlet conduit 7 is opened; this vents the left side of diaphragm 4 to the atmosphere and lets the trapped air escape. With conduits 6 and 7 both open, diaphragm 4 does not hinder the liquid that continues to flow in through conduit 6. Even though the resistance of trapped air is eliminated by the opening of conduit 7, diaphragm 4 continues to be lifted smoothly and evenly against the left side of container 2 by the rising liquid. The bulge in upper portion 12 that was created by trapped air eliminated wrinkles and creases and stretched the diaphragm out away from the inside surface of container 2 so that bubbles do not form between the diaphragm and the container. It has been found that to prevent wrinkles, creases and bubbles, the liquid inlet valve (i.e. 7) on the side of diaphragm 4 where air is trapped should not be opened until container 2 is at least about 15% full of liquid, and that such liquid inlet valve should not be kept closed after container 2 is more than about one-half full of liquid. Container 2 is loaded with liquid until a predetermined outage level 13 is reached, at which time conduits 7 and 8 are both closed. When a non-compatible liquid is to be loaded into container 2, the same sequence of steps should be followed on reverse sides of diaphragm 4.

Figure 7:
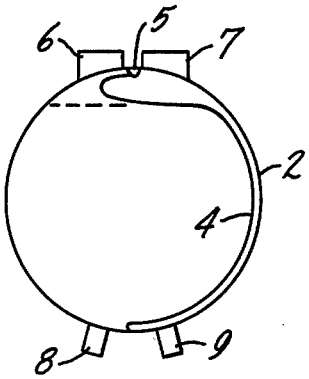
FIGS. 7–9 are cross sectional views taken generally through the center of the tank car of FIG. 1 illustrating in sequence the positions of the diaphragm during the method of unloading a tank car in accord with this invention.
Figure 8:
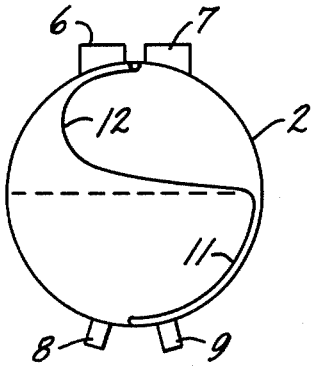
Figure 9:
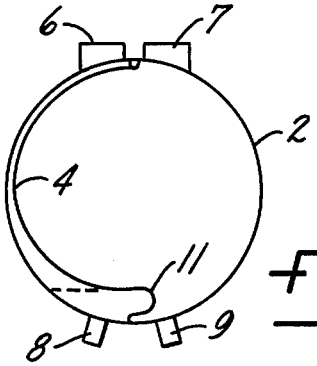

After a fully loaded tank car 1, as shown in FIG. 6, has been transported to a predetermined destination, the liquid can be completely unloaded without resulting in damage to diaphragm 4 by causing a partial vacuum to form between the diaphragm and the upper surface of the liquid. To accomplish this, the outlet conduit 8 on the same side of the diaphragm as the liquid is opened to drain the liquid from the container. At essentially the same time or even before conduit 8 is opened, the inlet conduit 7 on the opposite side of diaphragm 4 is opened. As the liquid drains from container 2 through the open outlet conduit 8 a partial vacuum is created above the liquid. This causes the upper portion 12 of the diaphragm 1 to lie against the upper portion of container 2, as shown in FIGS. 7 and 8. This also causes diaphragm 4 to cover and seal off liquid inlet conduit 6. As the liquid level descends the partial vacuum continues to draw diaphragm 4 to the left and causes the diaphragm to progressively lie against and line the intermediate and then lower portions of container 2. The diaphragm is stretched by the partial vacuum against the weight of the liquid holding the diaphragm against the right side of container 2. This puts the diaphragm in tension and straightens out any wrinkles or creases in the tensioned portion of the diaphragm that could cause damage; it also prevents air or liquid from being trapped between the diaphragm on either the right or the left side of container 2 which results in the container being fully unloaded. When essentially all of the liquid has been unloaded from container 2, the liquid inlet conduit 6 on the same side of diaphragm 4 as the liquid is opened. This releases the partial vacuum and causes diaphragm 4 to settle to the bottom of container 2 essentially as shown in FIG. 2, where it is in position for loading of a liquid into either of the chambers it defines in container 2. When a non-compatible liquid is to be unloaded from container 2, the same sequence of steps should be followed on reverse sides of diaphragm 4.

Although the loading method and the unloading method disclosed herein are independently usable, maximum benefit can be obtained when both methods are used for each tank car 1. This will permit the full volume of tank car 1 to be used at all times because the car is always completely loaded and unloaded. The loading and unloading can be carried out rapidly without concern about damage to diaphragm 4 because the trapped air or the partial vacuum stretch out the diaphragm under tension and prevent the formation of creases, wrinkles and bubbles.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. The method of loading an enclosed container which has its interior changeable into different chambers for non-compatible liquids by a flexible diaphragm that alternately lines opposite portions of such container, comprising the steps of:

A. emptying the liquid from said container and flowing air at atmospheric pressure into the chambers on both sides of said diaphragm;

B. sealing one of said chambers so as to trap air at atmospheric pressure on one side of said diaphragm;

C. venting the opposite side of said diaphragm to the atmosphere and flowing liquid into the chamber on said opposite side in such manner that the trapped air on said one side of said diaphragm is displaced by rising liquid, said displaced air moving the upper portion of said diaphragm in one direction while the rising liquid moves the lower portion of said diaphragm in the opposite direction, whereby said diaphragm is stretched out in tension as it is moved upwardly into contact with said container;

D. after said container is partially filled with liquid, releasing said trapped air by venting said one side of said diaphragm to the atmosphere;

E. continuing to load liquid into said container; and

F. sealing both of said chambers when the loading of said container is complete.

2. The invention defined in claim 1, wherein said one side of said diaphragm is vented when said container is about one-half full of liquid.

3. The invention defined in claim 1, wherein said one side of said diaphragm is vented when said container is from about 15% to about 50% full of liquid.

4. The method of unloading an enclosed container which has its interior changeable into different chambers for non-compatible liquids by a flexible diaphragm that alternately lines opposite portions of such container, comprising the steps of:

A. filling said container at atmospheric pressure with liquid in the chamber on only one side of said diaphragm;

B. venting the opposite side of said diaphragm to the atmosphere;

C. draining the liquid from the lower portion of said chamber on said one side of said diaphragm while sealing to the atmosphere the portion of said chamber above said liquid, whereby a partial vacuum is created above said liquid which stretches out said diaphragm in tension and causes said one side of said diaphragm to initially lie against the upper portion of said container and to progressively line the intermediate and then lower portions of said container as the level of the liquid in said container descends; and D. venting to the atmosphere the top of said container on said one side of said diaphragm when essentially all of the liquid has been unloaded from said container.

5. The method of loading and unloading a railroad tank car having an enclosed container which has its interior changeable into different chambers for non-compatible liquids by a flexible diaphragm that alternately lines opposite portions of such container, comprising the steps of:

A. emptying the liquid from said container and flowing air at atmospheric pressure into the chambers on both sides of said diaphragm;

B. sealing one of said chambers so as to trap air at atmospheric pressure on one side of said diaphragm;

C. venting the opposite side of said diaphragm to the atmosphere and flowing liquid into the chamber on said opposite side in such manner that the trapped air on said one side of said diaphragm is displaced by rising liquid, said displaced air moving the upper portion of said diaphragm in one direction while the rising liquid moves the lower portion of said diaphragm in the opposite direction, whereby said diaphragm is stretched out in tension as it is moved upwardly into contact with said container;

D. after said container is partially filled with liquid, releasing said trapped air by venting said one side of said diaphragm to the atmosphere;

E. continuing to load liquid into said container;

F. sealing both of said chambers at atmospheric pressure when the loading of said container is complete;

G. transporting the loaded tank car to a predetermined destination;

H. then venting said one side of said diaphragm to the atmosphere;

I. draining the liquid from the lower portion of said chamber on said opposite side of said diaphragm while sealing to the atmosphere the portion of said chamber above said liquid, whereby a partial vacuum is created above said liquid which stretches out said diaphragm in tension and causes said opposite side of said diaphragm to initially lie against the upper portion of said container and to progressively line the intermediate and then lower portions of said container as the level of the liquid in said container descends; and J. venting to the atmosphere the top of said container on said opposite side of said diaphragm when essentially all of the liquid has been unloaded from said container.

6. The method of loading an enclosed container which has its interior changeable into different chambers for non-compatible liquids by a flexible diaphragm that alternately lines opposite portions of such container, there being conduits on opposite sides of said diaphragm adjacent the top of said container, and there being conduits on opposite sides of said diaphragm adjacent the bottom of said container, said method comprising the steps of:

A. emptying the liquid from said container and maintaining said container at atmospheric pressure;

B. closing both of the conduits adjacent the bottom of said container;

C. closing the conduit adjacent the top of said container on one side of said diaphragm;

D. opening the conduit adjacent the top of said container on the opposite side of said diaphragm;

E. loading liquid at atmospheric pressure into said container through the open conduit;

F. after said container is partially filled with liquid, opening said conduit adjacent the top of said container on said one side of said diaphragm;

G. continuing to load liquid at atmospheric pressure into said container through the first opened conduit; and H. closing both of said conduits adjacent the top of said container when the loading of said container is complete.

7. The invention defined in claim 6, wherein said conduit adjacent the top of said container on said one side of said diaphragm is opened when said container is about one-half full of liquid.

8. The invention defined in claim 6, wherein said conduit adjacent the top of said container on said one side of said diaphragm is opened when said container is from about 15% to about 50% full of liquid.

9. The method of unloading an enclosed container which has its interior changeable into different chambers for non-compatible liquids by a flexible diaphragm that alternately lines opposite portions of such container, there being conduits on opposite sides of said diaphragm adjacent the top of said container, and there being conduits on opposite sides of said diaphragm adjacent the bottom of said container, said method comprising the steps of:

A. filling said container at atmospheric pressure with liquid on only one side of said diaphragm;

B. opening the conduit adjacent the top of said container on the opposite side of said diaphragm;

C. opening the conduit adjacent the bottom of said container on said one side of said diaphragm;

D. draining the liquid from said container through the open conduit on said one side of said diaphragm, whereby, a partial vacuum is created above said liquid which causes said one side of said diaphragm to initially lie against the upper portion of said container and to progressively line the intermediate and then lower portions of said container as the level of the liquid in said container descends;

E. opening said conduit adjacent the top of said container on said one side of said diaphragm when essentially all of the liquid has been unloaded from said container.

10. The atmospheric pressure method of loading and unloading a railroad tank car having an enclosed container which has its interior changeable into different chambers for noncompatible liquids by a flexible diaphragm that alternately lines opposite portions of such container, there being liquid inlet conduits on opposite sides of said diaphragm adjacent the top of said container, and there being liquid outlet conduits on opposite sides of said diaphragm adjacent the bottom of said container, said method comprising the steps of:

A. closing both of the conduits adjacent the bottom of said container;

B. closing the conduit adjacent the top of said container on one side of said diaphragm;

C. opening the conduit adjacent the top of said container on the opposite side of said diaphragm;

D. loading liquid at atmospheric pressure into said container through the open conduit;

E. after said container is partially filled with liquid, opening said conduit adjacent the top of said container on said one side of said diaphragm;

F. continuing to load liquid at atmospheric pressure into said container through the first opened conduit;

G. closing both of said conduits at atmospheric pressure adjacent the top of said container when the loading of said container is complete;

H. transporting the loaded tank car to a predetermined destination;

I. then opening the conduit adjacent the top of said container on said one side of said diaphragm;

J. opening the conduit adjacent the bottom of said container on said opposite side of said diaphragm;

K. draining the liquid from said container through the open conduit on said opposite side of said diaphragm, whereby, a partial vacuum is created above said liquid which causes said opposite side of said diaphragm to initially lie against the upper portion of said container and to progressively line the intermediate and then lower portions of said container as the level of the liquid in said container descends; and L. opening said conduit adjacent the top of said container on said opposite side of said diaphragm when essentially all of the liquid has been unloaded from said container.

* * * * *